United States Patent [19]

Winter

[11] Patent Number: 4,916,419

[45] Date of Patent: Apr. 10, 1990

[54] CIRCUIT BREAKER CONTACT ASSEMBLY

[75] Inventor: John M. Winter, Cedar Rapids, Iowa

[73] Assignee: Square D Company, Palatine, Ill.

[21] Appl. No.: 282,887

[22] Filed: Dec. 9, 1988

Related U.S. Application Data

[63] Continuation of Ser. No. 922,576, Oct. 24, 1986, abandoned.

[51] Int. Cl.[4] ..... H01H 75/00

[52] U.S. Cl. ..... 335/16; 335/147; 335/195

[58] Field of Search ..... 335/6, 16, 35, 147, 335/195; 200/147 R

[56] References Cited

U.S. PATENT DOCUMENTS

| | | | |
|---|---|---|---|
| 3,593,227 | 7/1971 | Mitskevich et al. | 335/16 |
| 4,259,651 | 3/1981 | Yamat | 335/16 |
| 4,608,545 | 8/1986 | Kralik | 335/16 |
| 4,626,811 | 12/1986 | McKee et al. | 335/16 |
| 4,743,875 | 5/1988 | Murphy | 335/6 |

*Primary Examiner*—Leo P. Picard
*Assistant Examiner*—Lincoln Donovan
*Attorney, Agent, or Firm*—Mary R. Jankousky; Thomas B. Lindgren; Jose W. Jimenez

[57] ABSTRACT

A circuit breaker having a movable upper blade with a free floating pivot end. The operating mechanism is solidly connected to the upper blade. The contact force is generated by a contact spring which exerts an upward force on the lower blade. No other resilient force acts directly upon the upper blade. As the contacts separate, the force exerted on the upper blade is virtually eliminated, reducing substantially the resistance at the pivot end of the upper blade. The load terminal and pivot end of the upper blade provide a current path parallel to that of the load side flexible connector.

5 Claims, 4 Drawing Sheets

CIRCUIT BREAKER CONTACT ASSEMBLY

This application is a continuation of application Ser. No. 922,576, filed on Oct. 24, 1986 now abandoned.

This invention relates to circuit breakers and in particular to circuit breakers having a movable contact mounted on a pivotable blade.

CROSS REFERENCE TO RELATED APPLICATIONS

The present invention is related to material disclosed in the following copending U.S. applications, all of which are assigned to the same assignee of the present application and are herein incorporated by reference:

Ser. No. 922,966, entitled "Circuit Breaker Arc Stack Assembly" filed Oct. 24, 1986 by J. M. Winter;

Ser. No. 922,577, entitled "Trident Arc Horn for Circuit Breaker" filed Oct. 24, 1986 by A. A. Maulandi, K. J. Green, G. A. Volesky;

Ser. No. 922,968, entitled "Circuit Breaker with Positive Contact Indication" filed Oct. 24, 1986 by J. M. Winter, D. R. Schiefen;

Ser. No. 922,967 entitled "Circuit Breaker Trip Solenoid Assembly" filed Oct. 24, 1986 by J. M. Winter, R. F. Dvorak;

Ser. No. 922,575 entitled "Electronic Circuit Breaker with Withstand Capability" filed Oct. 24, 1986 by J. M. Winter.

DESCRIPTION OF THE PRIOR ART

Circuit breakers often have a moving contact mounted on a fixed pivotable blade that is controlled by an operating mechanism. In some designs a pair of links are directly connected to the movable blade to open and close the circuit breaker contacts as shown in FIG. 1.

As the current carried by the circuit breaker increases, constriction forces between the contacts may cause the contacts to blow apart. This problem is eliminated by increasing the contact force in any one of a number of ways. One method used in the prior art as shown in FIG. 2, is to place a flat spring and/or coil spring between the movable blade and the blade carrier. The lower contact exerts an upward force A on the moving contacts at the right end of the movable blade. The flat spring positioned between the blade carrier and movable blade exerts a consistent downward force B near the middle of the movable blade. Since the operating mechanism is connected to the blade carrier and controls the position of the movable blade via the flat spring, the flat spring acts as the pivot point for the movable blade. After applying forces A and B to the movable blade, the resultant force C is exerted by the line terminal upwards on the pivot end of the movable blade. At all times, even as the movable blade opens, an upwards force will be exerted against the pivot point of the movable blade because of the springs trying to force apart the movable blade and the blade carrier. This upwards force wears down both the load terminal and the pivot end of the blade as shown by the phantom lines in FIG. 3. The wearing of the terminal and the blade increases the resistance and the power loss of the circuit breaker. The power loss of a circuit breaker is particularly important when the circuit breaker is mounted in a panelboard or other enclosure having specific heat rise limitations.

It is an object of this invention to provide a circuit breaker with a movable blade pivot assembly having a low friction coefficient.

It is a further object of this invention to provide a movable blade pivot assembly that has a parallel current path.

The foregoing and other objects, features and advantages of this invention will be apparent from the following more particular description of a preferred embodiment thereof, as illustrated in the accompanying drawings and in the claims.

BRIEF DESCRIPTION OF THSE DRAWINGS

DESCRIPTION OF THE PREFERRED EMBODIMENT

Figure 1:
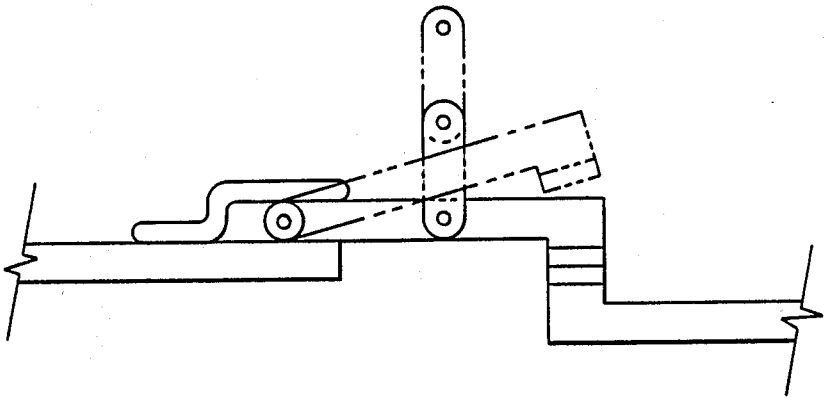
FIG. 1 is a side view of a portion of the contact assembly and mechanism of a circuit breaker.
Figure 2:
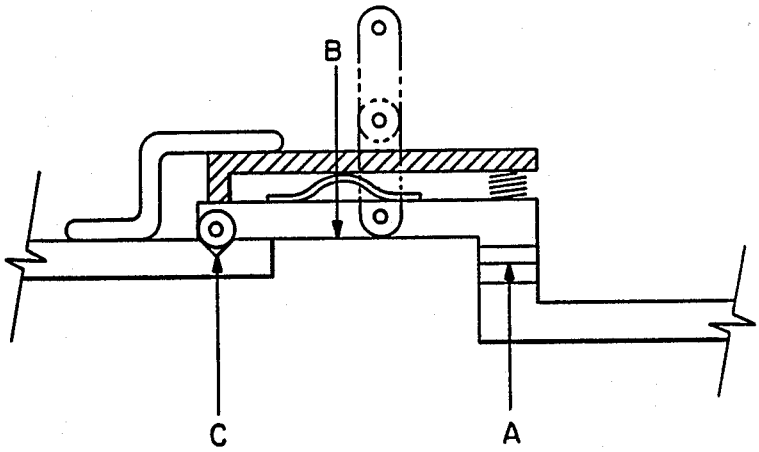
PRIOR ART FIG. 2
FIG. 2 is a side view of a portion of the contact assembly and operating mechanism of a prior art circuit breaker.
Figure 3:
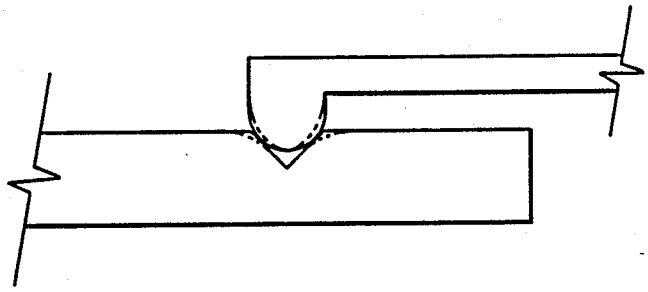
PRIOR ART FIG. 3
FIG. 3 is a side view of a moving blade pivot assembly of FIG. 2.
Figure 4:
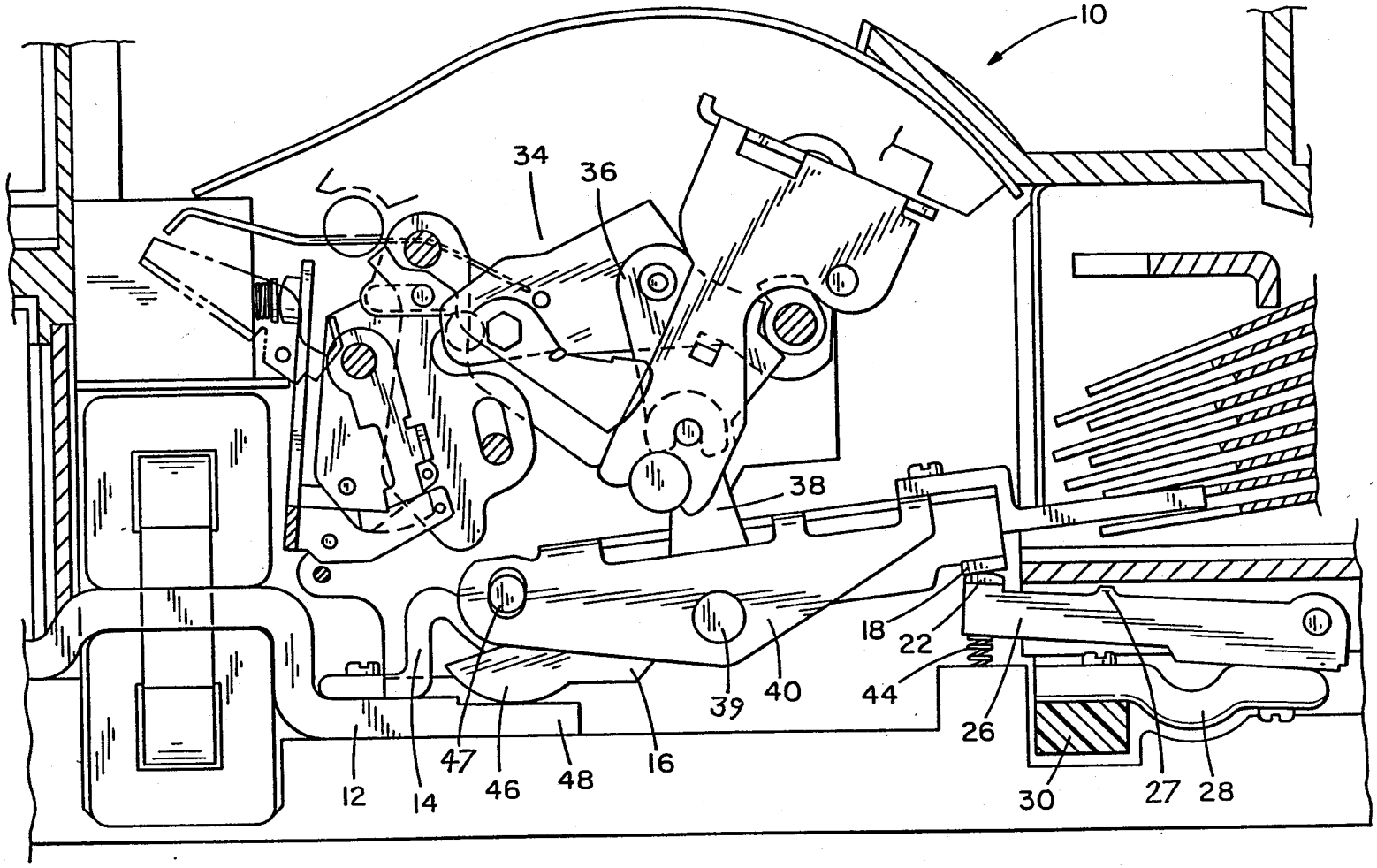
FIG. 4 is a side view of a circuit breaker having a floating pivot blade in the closed position.
Figure 5:
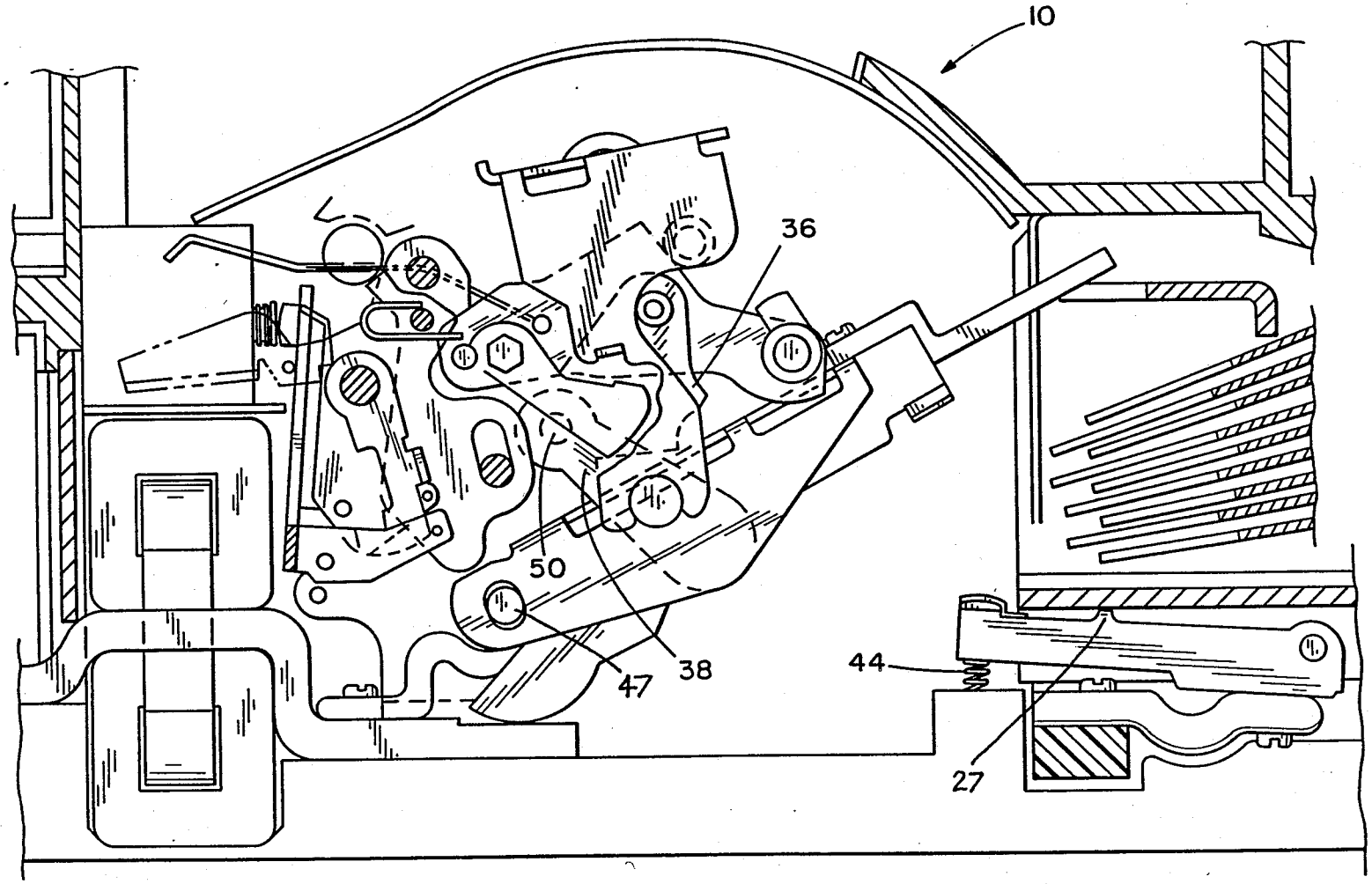
FIG. 5 is a side view of a circuit breaker having a floating pivot blade in the manually opened position.

Referring now to the drawings and in particular to FIGS. 4 and 5, the circuit breaker is indicated generally by the reference character 10. The current path through the circuit breaker is via the load terminal 12, load side flexible connector 14, upper blade 16, moving main contact 18 and (not shown), lower main and arcing contacts 22 and 24 (FIG. 6), respectively, lower blade 26, line side flex connector 28 and line terminal 30. The contacts are open and closed by moving the upper blade 16 via the operating mechanism, indicated generally as 34.

The operation of the operating mechanism is described in more complete detail in patent application Ser. No. 922,966 for a "Circuit Breaker Arc Stack Assembly", as identified above. For the purposes of our discussion here, it is sufficient to note that in the circuit breaker closed position, as shown in FIG. 4, the upper link 36 and lower link 38 form a nearly straight line to force the upper blade 16 and the upper blade carrier 40 down. The moving main contact 18 and moving arcing contact then engage the lower main contacts 22 and lower arcing contact 24, depressing the contact springs 44 to provide the necessary constant force. The lower blade 26 may only move vertically a fixed distance because of stop tab member 27 butting against an interior surface of the circuit breaker housing.

The contact springs 44 are the only components that create contact force. In the circuit breaker closed position, the lower main and arcing contacts, 22 and 24, respectively, exert an upwards force on the right side of the upper blade 16 via the moving main and arcing contacts, as shown in FIG. 4. The lower link 38 exerts a downwards force near the center of the upper blade 16 via the upper blade carrier 40. The upper blade carrier 40 is solidly connected to the upper blade 16.

The upper blade 16 is approximately rectangular in shape and has moving main contacts 18 and a moving arcing contact mounted at one end and a rounded pivot end 46 at the other end. The pivot end 46 rests on a ledge 48 of the load terminal 12. The pivot end 46 of the upper blade 16 is free floating and does not rotate about a fixed point. A loose pivot arrangement 47 comprises a fixed pin secured to the breaker housing (by means not shown) confined in an elongated slot in upper blade carrier 40. This permits slight movement of upper blade carrier 40 as rounded pivot end 46 moves on the surface formed by ledge 48 of load terminal 12.

When the circuit breaker is in the closed position, as shown in FIG. 4, the downwards force exerted by the lower link 38 and the upwards force exerted by the lower main and arcing contacts create a resultant downwards force exerted by the pivot end 46 on the load terminal ledge 48. Since the lower link force is applied in approximately the middle of the upper blade 16, the upwards force at the contacts end of the upper blade 16 is approximately equal to the downwards force exerted by the pivot end 46.

Figure 6:
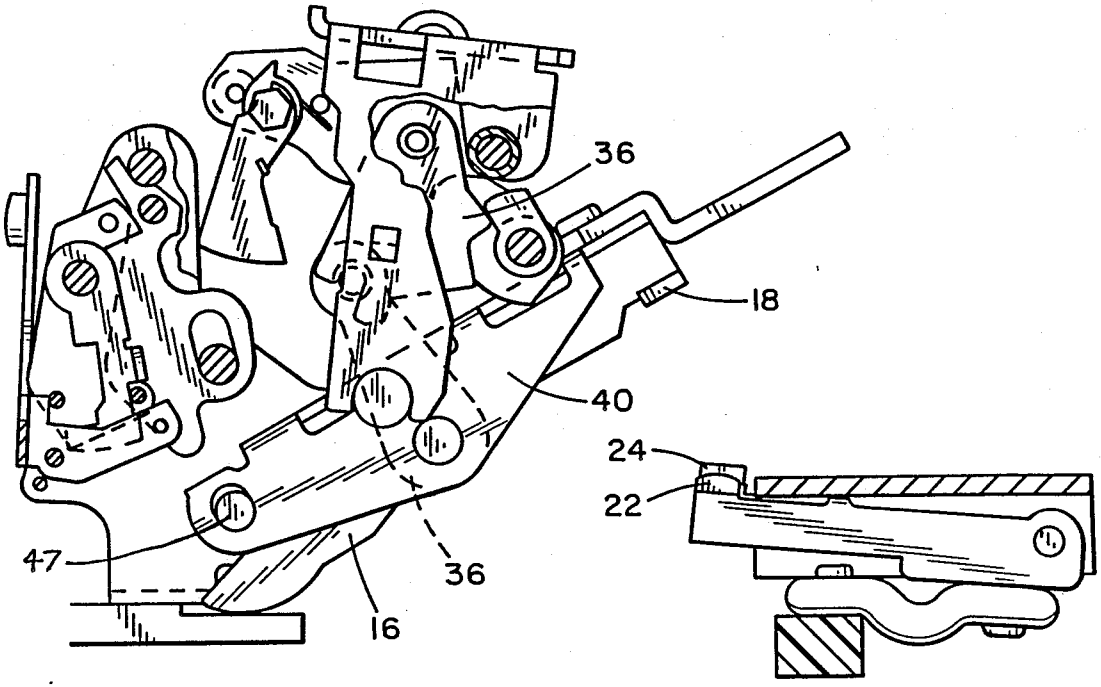
FIG. 6 is a side view of a circuit breaker having a floating pivot blade in the tripped position.

When the circuit breaker is either manually opened or tripped, as shown in FIGS. 5 and 6, respectively, the operating mechanism 34 causes the upper link 36 and lower link 38 to collapse. The link pivot 50 moves to the left, as shown in FIGS. 5 and 6, as assisted by the lower link stationary pivot 39, causing the lower link 38 to move the upper blade carrier 40 and upper blade 16 in the upwards direction. The other components of the operating mechanism have different positions in the tripped position than in the manually opened position. It is sufficient for the purposes herein to recognize that in both positions the upper link 36 and lower link 38 collapse, causing the contacts to separate.

In the tripped or open position, the resultant force on the pivot end 46 is greatly reduced, essentially to zero, as soon as the contacts part. In these positions, the upper link 36 and lower link 38 hold the upper blade 16 open so that the only downwards force on the moving blade pivot end 46 is a portion of its own weight and any downward bias from the flexible connector 14. As soon as the moving contact separates from the lower main contact 22 and lower arcing contact 24, the contact spring 44 no longer exerts a force on the upper blade 16. There is no downwards force on the upper blade as that which resulted from the flat spring between the upper blade and the upper blade carrier in the prior art. For the greater portion of the opening cycle, there is little force on pivot end 46 of the upper blade 16, greatly reducing the wear on the pivot end.

The load terminal ledge 48 and the pivot end 46 provide a current path parallel to that of the load side flexible connector 14. In the design as shown, roughly half of the current flows through each current path, thus reducing the power loss and heat rise. In the circuit breaker shown and described herein, the overall heat loss of the circuit breaker was reduced by approximately ten percent by the use of the two parallel paths.

The pivot end 46 and load terminal ledge 48 provide a current path between the load terminal 12 and upper blade 16 via a pressure fit. The pressure connection between these two current carrying members must be as smooth as possible. Any wear on the pivot end 46 or on the load terminal ledge 48 will cause that pressure connection to deteriorate, resulting in a higher resistance in that current path. The part dimensions of the load terminal 12 and upper blade 16 are critical when a fixed pivot is used but not with the use of the floating pivot design.

The upper blade 16 is made of copper or another material having a low electrical resistance. Since these materials also often are relatively soft, the pivot end 46 of the upper blade 16 wears very poorly. Thus it is important to reduce the upwards force on the pivot end 46 as quickly and as much as possible. By eliminating the prior art spring positioned between the upper blade carrier 40 and the upper blade 16, the downwards force previously applied by the blade spring to the upper blade continuously is eliminated as soon as the contacts part. The wear on the pivot end 46 is reduced considerably. The watts lost through the circuit breaker will stay approximately constant during the life of the circuit breaker. The floating pivot design is a simple and inexpensive solution to a recurring problem.

While the invention has particularly been shown and described with reference to a preferred embodiment it will be understood by those skilled in the art that variations in form, construction and arrangement may be made therein without departing from the spirit and scope of the invention.

I claim:

1. A circuit breaker comprising:

a first contact mounted on a first movable blade, the first movable blade having a curved surface cooperating with a stationary flat load contact terminal surface to form a floating pivot adjacent to one end;

a second contact mounted on a second movable blade;

an operating mechanism connected to the first movable blade, said operating mechanism moving said first movable blade between an open position and a closed position, wherein in said open position said first contact and said second contact are separated, wherein in said closed position said first contact and said second contact are engaged;

a resilient member acting on the second movable blade to move said second contact toward said first contact;

said resilient member supplying the sole contact pressure between said first contact and said second contact; and a first flexible connector, said first flexible connector being connected to said first terminal and to said first movable blade;

said floating pivot being under substantially zero loading when said first contact and said second contact are in said open position.

2. A circuit breaker as claimed in claim 1 wherein said operating mechanism is operably connected to said first movable blade.

3. A circuit breaker as claimed in claim 1 wherein said operating mechanism is operably connected to said first movable blade.

4. A circuit breaker comprising:

a first contact mounted on a first movable blade, said first movable blade having a curved surface at one end;

a second contact mounted on a second movable blade;

an operating mechanism connected to said first movable blade for moving said first movable blade between an open position wherein said first contact and said second contact are separated and a closed position wherein said first contact and said second contact are engaged;

a spring urging said second contact into engagement with said first contact and providing the sole force acting on said contacts in said closed position, whereby substantially zero loading is applied to said one end of said first movable blade in said open position;

a load terminal forming a stationary flat surface;

a flexible connector interconnecting said load terminal with said first movable blade; and said curved surface and said stationary flat surface cooperating to form a floating pivot for said first movable blade, said first movable blade being conductive and said floating pivot completing a parallel conductive path between said load terminal and said first movable blade.

5. A circuit breaker of the type including a first contact carried by a contact carrier and a second contact, an operating mechanism for moving said contact carrier to bring said first contact into engagement with said second contact, said first contact including a contact arm having a curved end for mechanically and electrically engaging a load terminal surface in a floating pivot, the improvement comprising:

spring means for urging said second contact towards said first contact, said spring means providing the sole contact pressure when the circuit breaker is in the closed condition and resulting in said floating pivot experiencing substantially zero loading when said circuit breaker is in an open condition.

* * * * *